United States Patent [19]

Koski

[11] Patent Number: 4,925,531

[45] Date of Patent: May 15, 1990

[54] TWIN WIRE FORMER FOR A PAPER MACHINE

[75] Inventor: Erkki Koski, Jyväskylä, Finland

[73] Assignee: Valmet Paper Machinery Inc., Finland

[21] Appl. No.: 355,180

[22] Filed: May 22, 1989

[30] Foreign Application Priority Data

May 23, 1988 [FI] Finland ..... 882422

[51] Int. Cl.[5] ..... D21F 1/00

[52] U.S. Cl. ..... 162/301; 162/303; 162/352

[58] Field of Search ..... 162/300, 301, 303, 348, 162/352

[56] References Cited

U.S. PATENT DOCUMENTS 4,209,360 6/1980 Stenberg ..... 162/301
4,417,950 11/1983 Bubik et al. ..... 162/300
4,532,008 7/1985 Creagan et al. ..... 162/301

FOREIGN PATENT DOCUMENTS 3222428 12/1983 Fed. Rep. of Germany ..... 162/301
1119796 6/1986 Japan ..... 162/348

*Primary Examiner*—Karen M. Hastings
*Attorney, Agent, or Firm*—Steinberg Raskin

[57] ABSTRACT

A twin-wire former for a paper machine having a lower wire and an upper wire. The former has a twin-wire forming zone which has forming members and forming zones situated in a specific sequence as follows. A downwardly curved forming zone is confined to a sector of a large-diameter forming roll mounted on a frame of a lower wire unit, the magnitude of this sector being within the range of <90°. A second forming roll then follows which is preferably provided with a hollow face and onto which the wires arrive from the first forming roll. The twin-wire forming zone is curved within a certain sector of less than 90° on the second forming roll so as to become horizontal. A forming shoe is provided with a ribbed deck and fitted after the second forming roll inside the lower wire loop, this forming shoe having a relatively large curve radius after which the twin-wire forming zone ends and the web is arranged to follow along with the lower wire.

16 Claims, 1 Drawing Sheet

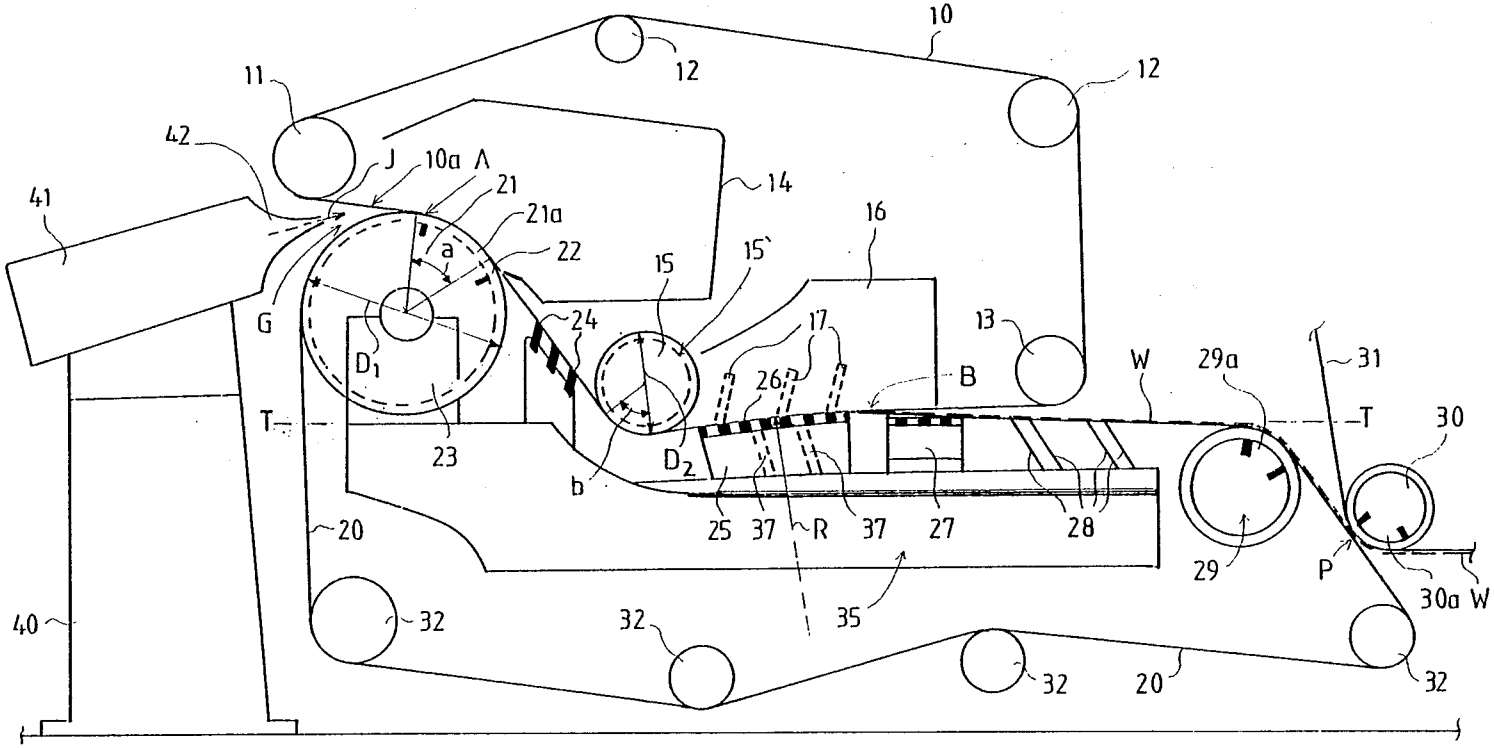
10
11
12
12
13
14
15
15'
16
17
20
20
21
21a
22
23
24
25
26
27
28
29
29a
30
30a
31
32
32
32
32
35
37
37
40
41
42
A
B
G
J
P
R
T
T
W
W
a
b
D1
D2
10a

TWIN WIRE FORMER FOR A PAPER MACHINE

BACKGROUND OF THE INVENTION

The present invention concerns a twin-wire former for a paper machine, in particular for rebuilding of existing fourdrinier wire parts. The twin-wire former comprises a lower wire and an upper wire, these wires being guided by guide rolls, by forming rolls, and by a web-forming member. The former comprises a first forming roll at which the lower wire which runs over the first forming roll together with the upper wire, defining a forming gap in connection with the first forming roll, into which a slice part of a headbox feeds a pulp suspension jet.

With respect to the prior art related to the present invention, reference is made to a twin-wire former marked by Valmet under the trademark SPEED-FORMER HHS, which is a gap former principally intended for rebuilding of existing fourdrinier wire parts. A first object of the present invention is to provide a new former concept principally for the same purposes as this SPEED-FORMER HHS.

A starting point of the present invention is a so-called gap former in which, in a gap area, a forming roll or cylinder or relatively large diameter is used.

With respect to further prior art most closely related to the present invention, reference is made to FI Patent Application No. 851035 (Beloit Corporation), corresponding to U.S. Pat. No. 4,209,360 as well as to U.S. Pat. No. 4,209,360 corresponding to SE Pat. No. 7800775-4 (AB Karlstads Mek. Verkstad). The objectives of the present invention are partially the same as those of U.S. Pat. No. 4,209,360.

SUMMARY OF THE INVENTION

Accordingly, it is an object of the present invention to provide a new type of former which is well-suitable for rebuilding of existing fourdrinier wire parts, i.e. for conversion of such formers to twin-wire formers so that the frame structures, the rolls, and the draining equipment of the old wire unit can be retained to as great an extent as possible.

It is a further object of the present invention to provide a twin-wire former by means of which good retention and formation are obtained and in which unequal-sidedness of the web to be formed is avoided, i.e. the paper web to be produced can be made as symmetric as possible, and such that the web has adequate internal bond strength.

These and other objects are attained by the present invention which is directed to a twin-wire former for a paper machine having a twin-wire forming zone comprising, in the following sequence of twin-wire run, (i) a downwardly-curved forming zone confined to a sector of a first forming roll, (ii) a second forming roll situated after the first forming roll, being situated at a lower level than the first forming roll, and also arranged to curve the twin-wire zone thereabout to become (a) substantially horizontal, (b) slightly upwardly inclined, or (c) slightly downwardly inclined, and (iii) a third forming element fitted after said second forming roll, after which the twin-wire forming zone ends.

More specifically, the first forming roll has a large diameter and the second forming roll has a diameter substantially smaller than the diameter of the first forming roll, with the first forming roll being mounted on a frame of a lower wire unit, and magnitude of the sector of the first forming roll being less than about 90°. The first forming roll also comprises a suction zone situated within the sector thereof, with the second forming roll also having a sector for the curving of the twin-wire zone thereabout, which is less than about 90°. Furthermore, the third forming element is (1) a forming shoe fitted inside a lower wire loop, mounted on the frame of the lower wire unit, and having a ribbed deck with a relatively large curve radius, or (2) a combination of deflectors situated in an upper wire loop and in the lower wire loop.

The twin wire zone is preferably arranged to direct a web formed therein upon a lower wire forming the lower wire loop after the twin-wire zone ends. Preferably, the second forming roll comprises a hollow-face, and the first and second forming rolls are arranged with respect to one another to direct the twin-wire zone as a substantially straight downward run from the first forming roll to the second forming roll. The former comprises a lower wire and an upper wire guided by guide rolls, with the lower and upper wires being arranged to both run over the first forming roll and define a forming gap thereat, into which a slice part of a head box is arranged to feed a pulp suspension jet.

Accordingly, in view of achieving the objects stated above and those which will become apparent below, the present invention is principally characterized by a former comprising a twin-wire forming zone, which comprises the forming members and forming zones situated in the sequence give below:

(a) a downwardly curved forming zone, which is confined to the sector of a large-diameter forming roll mounted on the frame of the lower wire unit, the magnitude of this sector being within the range of $a<90°$ and the suction zone of the first forming roll being situated within the area of this sector;

(b) a second forming roll which is preferably provided with a hollow face, and onto which the wires arrive from the first forming roll preferably as a straight downwardly run, with the diameter of the second forming roll being substantially smaller than the diameter of the first forming roll, the second forming roll being placed at a lower level than the first forming roll, and the twin-wire forming zone being curved on the second forming roll within a certain sector thereof of less than 90° so as to become substantially horizontal or slightly upwardly or downwardly inclined; and (c) a forming shoe provided with a ribbed deck and fitted after the second forming roll inside the lower-wire loop, mounted on the frame construction of the lower wire unit, this forming shoe having a relatively large curve radius, or a corresponding deflector combination after which the twin-forming zone ends and the web is arranged to follow along with the lower wire.

A number of advantages of different directions are carried into effect at the same time by means of the present invention. In the invention, the first forming roll can be supported and journaled on the frame of the lower wire unit, in the case of rebuilding of the existing fourdrinier wire part on the frame, which is an essential advantage as compared, e.g., with the construction of the SPEED-FORMER HHS, in which the corresponding forming roll is supported on the upper wire unit.

In the construction in accordance with the present invention, the first forming roll is not susceptible to being flooded, because its suction area is on an upper sector of the roll.

The footing constructions of the headbox must be made higher in the case of renewals with the present invention, there being usually adequate space available.

In addition to the principal constructional advantages noted above, the above process-technical objects related to web formation and dewatering are also obtained by means of the present invention.

BRIEF DESCRIPTION OF THE DRAWINGS

The present invention will be described in greater detail below with reference to an advantageous exemplary embodiment of the invention illustrated in the accompanying figure, in which FIG. 1 is a schematic side view of a twin-wire former in accordance with the present invention.

DESCRIPTION OF THE PREFERRED EMBODIMENTS

The paper machine former illustrated in FIG. 1 comprises an upper wire unit and a lower wire unit. The upper-wire unit includes an upper wire 10 guided by guide rolls 11, 12, 13 and by forming rolls 21, 15, as well as by a deck 26 of a forming shoe 25. The upper-wire unit further includes frame constructions (not illustrated) and water draining troughs 14, 16.

The lower-wire unit includes a lower wire 20 guided by the forming rolls 21, 15, by the forming shoe 25, and by dewatering members 27, 28 and guide rolls 29 and 32. The lower-wire unit includes a frame, of which a frame part 35 is illustrated in FIG. 1. Bearing supports 23 of the first forming roll 21 are attached on the frame part 35.

When the present invention is applied to modernizing existing fourdrinier formers, it is to a very great extent possible to make use of the existing frame part of the fourdrinier wire, of the draining equipment at the rear end thereof, of rolls 29 and 32, as well as of pick-up roll 30. In the present invention, the forming roll 21 is expressly supported and journalled on the frame part 35 by means of the bearing supports 23, such construction being considerably more advantageous than a construction in which a roll corresponding to the roll 21 would have to be supported and journalled in conjunction with the upper-wire unit.

The upper wire 10 and the lower wire 20 define a twin-forming zone A-B between the same, with water being removed out of the web W that is being formed within this zone through both wires 10 and 20.

After the twin-wire forming zone A-B, starting from a suction box 27 or equivalent, the web W follows the lower wire 20 which thus acts as a so-called carrying wire and carries the web W over a suction zone 29*a* of the roll 29 to a detaching point P, where the web W is transferred onto a suction zone 30*a* of the pick-up roll 30 and onto a pick-up felt 31 which carries the web W further to a press section (not illustrated).

The twin-wire forming zone A-B is preceded by a forming gap G which is defined from below by an upper quarter of the forming roll 21 over which the lower wire 20 runs, as well as by a straight run 10*a* of the upper wire 10 which runs from the guide roll 11 onto the forming roll 21 and onto a pulp web that is being formed. A pulp jet J is fed into the forming gap G through a slice part 42 of a head box 41 situated on a stand 40.

After the forming gap G, the twin-wire zone A-B is curved downwardly on a sector a of the forming roll 21. A suction zone 21*a* of the forming roll 21 is situated substantially within this sector a, this suction zone 21*a* being defined by laths 22 of a suction chamber which operate against an inner face of the perforated roll mantle. Dewatering takes place mostly through the upper wire 10 on the sector a of the roll 21. Pressure formed between the wires is maintained at an equilibrium by the upper-wire tensioning pressure $p=2T_1/D_1$ ($T_1$=tensioning of the wire 10). The centrifugal force promotes the draining of water towards the trough 14. Some water may also drain through the lower wire 20 towards the suction zone 21*a*, partly because of the negative pressure prevailing therein. The amount of this latter dewatering depends upon the level of negative pressure in the suction zone 21*a*. This level can be regulated to a suitable level so as to adjust ratios of dewatering taking place through the upper wire 10 and the lower wire 20 on the sector a, in view of optimizing the formation of the web W.

The forming sector a is formed by a joint downwardly inclined run of the wires 10 and 20 onto the forming roll 15. On this run and inside a loop of the lower wire 20, there is one or several deflectors 24 which remove water out of the web W that is being formed.

The second forming roll 15 situated inside the loop of the upper wire 10, is a hollow-faced 15' (diameter $D_2$) roll 15 on whose sector b the run of the wires 10, 20 and of the pulp web situated between the same, is turned and becomes substantially horizontal. On the sector b the water is drained by the effect of the lower-wire 20 tensioning pressure $p=2D_2/T_2$ ($T_2$=tension of the wire 20) and aided by the centrifugal force, the water being drained substantially through the lower wire 20 and to a certain extent also into the hollow face 15' of the forming roll 15 from which the water is thrown into the trough 16.

The forming roll 15 is followed by a forming shoe 25 situated inside a loop of the lower wire 20, the forming shoe being most appropriately provided with a ribbed deck 26. In the direction of running of the wire 10, 20, the deck 26 has a relatively large curve radius R whose center of curvature is at a side of the lower wire 20 as illustrated.

The ribbed deck 26 of the forming shoe 25 is followed by a suction box 27 with a curved deck situated within the loop of the lower wire 20 and ensuring that the web W follows along with the lower wire 20. After the point B of detaching of the web W from the upper wire 10, there may be deflectors 28, dry suction boxes, or other corresponding dewatering members inside the loop of the lower wire 20.

The forming shoe 25 may be substituted with a corresponding deflector combination. Of such possible deflectors, deflector 17 situated inside the upper-wire loop 10 and deflectors 37 situated inside the lower wire loop 20 are illustrated by means of dashed lines in the figure. The deflector 17 and 37 can be alternatingly situated, preferably so that the twin-wire forming zone guided by the same runs along a very gently meandering, substantially sine-shaped path.

When a forming shoe 25 is used, water is drained principally by the effect of the curve radius R through the upper wire 10 into the trough 16, as well as to a certain extent towards the ribbed deck 26 of the shoe 25 being aided by gravity and, if necessary, by suction. The ribbed deck 26 gives the web pressure impulses which improve its formation.

Concerning the different dimensional proportions of the former described above, it can be ascertained that the forming roll 21 or corresponding cylinder has quite a large diameter $D_1$, which is as a rule within a range of $D_1$=about 800–2000 mm., most appropriately within a range of $D_1$=about 1200–1600 mm.

The forming roll 15 that follows after the forming roll 21 has a diameter $D_2$ which is considerably smaller than the diameter $D_1$. The diameter $D_2$ of the roll 15 is as a rule within the range of $D_2$=about 700–1200 mm., most appropriately within the range of $D_2$=about 900–1000 mm.

The twin-wire zone sector a defined on the forming roll 21 in accordance with the present invention, has a width of a < about 90°, preferably a=about 40°–70° and most preferably a=about 60°. The turning sector b of the forming roll 15 provided with a hollow fac 15' is substantially equally as large as the sector a of the first forming roll 21 which, as a rule, means that the sector a begins at a topmost point of the roll 21, and the twin-wire zone continues on from the roll 15 to the forming shoe 25 as substantially horizontal.

After the roll 15, the forming zone is substantially horizontal additionally because in this manner it is possible to utilize the frame constructions and the draining equipment of the existing wire part as advantageously as possible. Thus, it is preferred that in the case of rebuilding, the plane of the wire in an existing fourdrinier former joins the plane T-T illustrated in the accompanying FIG. 1. This construction is also advantageous from the point of view that bearing supports 23 of the first forming roll 21 can be mounted on the frame constructions of the existing wire part, most advantageously so that the entire roll 21 is situated above the plane T-T. In such a manner, the stand 40 of the head box 41 must be substantially raised by the dimension of the diameter $D_1$ of the roll 21.

The curve radius R of the forming shoe 25 is, as a rule, within a range of R=about 2000–5000 mm., most appropriately R=about 3000 mm. The length of the twin-wire zone A-B is as a rule within a range of about 5–8 m.

An axis of rotation of the forming roll 15 is most appropriately at a level somewhat lower than an axis of rotation of the forming roll 21. The forming roll 21 is not susceptible to being flooded, because its suction sector **21*a* is situated on the upper half of the roll 21**.

The overall geometry of the former is most appropriately such that the pulp jet J is discharged from the slice part 42 of the head box 41 as slightly upwardly inclined or substantially horizontally, and such that after the end point B of the twin-wire zone, the run of the lower wire 20 is substantially horizontal.

Various details of the present invention may vary within the scope of the inventive concepts set forth above which have been presented for the sake of example only. In other words, the preceding description of the present invention is merely exemplary, and is not intended to limit the scope thereof in any way.

What is claimed is:

1. A twin-wire former for a paper machine, having a twin-wire forming zone comprising, in the following sequence of twin-wire run, (i) a downwardly curved forming zone confined to a sector of a first forming roll, (ii) said twin wire run comprising a lower wire loop unit and an upper wire loop unit guided by guide rolls, the lower and upper wires being arranged to both run over said first forming roll and define a forming gap thereat, into which a slice part of a headbox is arranged to feed a pulp suspension jet, (iii) a second forming roll situated after said first forming roll, being situated at a lower level than said first forming roll, and also arranged to curve the twin-wire run thereabout to become either (a) substantially horizontal, (b) slightly upwardly inclined, or (c) slightly downwardly inclined, and (iv) a third forming element fitted after said second forming roll, said third forming element being either (1) a forming shoe fitted inside the lower wire loop, mounted on the frame of the lower wire unit, and having a ribbed deck with a relatively large curved radius, or (2) a combination of deflectors situated in the upper wire loop and in the lower wire loop after which the twin-wire forming zone ends and wherein said first forming roll has a large diameter and said second forming roll has a diametet substantially smaller than the diameter of said first forming roll, said first forming roll is mounted on a frame of the lower wire unit and is located within the lower wire unit, magnitude of said sector of said first forming roll is less than about 90° , and said second forming roll has a sector for the curving of the twin-wire zone which is less than about 90°.

2. The twin-wire former of claim 1, wherein said first forming roll comprises a suction zone situated within said sector thereof, and said twin-wire zone is arranged to direct a web formed therein upon the lower wire forming the lower wire loop after said twin-wire zone ends.

3. The twin-wire former of claim 2, wherein said second forming roll comprises a hollow-face, and said first and second forming rolls are arranged with respect to one another to direct the twin-wire zone as a substantially straight downward run from said first forming roll to said second forming roll.

4. The twin-wire former of claim 1, wherein said twin-wire zone is arranged to start in an area of a top-most point on said first forming roll.

5. The twin-wire former of claim 2, wherein the magnitude of said sector of said first forming roll is from about 40° to 70°, and the magnitude of said sector of said second forming roll is substantially equal to said first forming roll sector magnitude.

6. The twin-wire former of claim 5, wherein the magnitude of said first forming roll sector is about 60°.

7. The twin-wire former of claim 2, wherein the diameter of said first forming roll is about 800–2,000 mm. and the diameter of the said second forming roll is about 700–1200 mm.

8. The twin-wire former of claim 7, wherein the diameter of said first forming roll is about 1200–1600 mm., and the diameter of said second forming roll is about 900–1000 mm.

9. The twin-wire former of claim 2, wherein said third forming element is said forming shoe with said curve radius of said ribbed deck thereof being about 2000 to 5000 mm

10. The twin-wire former of claim 9, wherein said radius is about 3,000 mm.

11. The twin-wire former of claim 3, additionally comprising at least one dewatering deflector situated adjacent said substantially straight downward run from said first forming roll to said second forming roll.

12. The twin-wire former of claim 11, wherein said at least one deflector is situated within the lower wire loop.

13. The twin-wire former of claim 2, wherein said third forming element is said deflectors which are arranged to guide said twin-wire zone along a gently-meandering, sine-shaped path.

14. The twin-wire former of claim 2, wherein the frame of the lower wire unit is a frame of a fourdrinier wire unit, additionally comprising draining equipment situated within the lower wire loop which is draining equipment of the fourdrinier wire unit, and said twin-wire zone is arranged to end such that a plane of the lower wire subsequently carrying the web substantially joins a plane of an upper run of a fourdrinier wire of the fourdrinier unit, said former constituting a rebuilding of existing fourdrinier wire parts.

15. The twin-wire former of claim 14, wherein said first forming roll is journaled and supported upon the frame by means of bearing supports.

16. The twin-wire former of claim 15, wherein said first forming roll is journaled to remain entirely above the plane of the upper run of the fourdrinier wire.

* * * * *